US010345087B2

(12) United States Patent
Choiniere et al.

(10) Patent No.: US 10,345,087 B2
(45) Date of Patent: Jul. 9, 2019

(54) MID BODY SEEKER PAYLOAD

(71) Applicant: BAE SYSTEMS Information and Electronic Systems Integration Inc., Nashua, NH (US)

(72) Inventors: Michael J. Choiniere, Merrimack, NH (US); Jason H. Batchelder, Lyndeborough, NH (US); Peter J. Evans, Seabrook, NH (US); Gregory R. Hallerman, Nashua, NH (US)

(73) Assignee: BAE Systems Informaticn and Electronic Systems Integration Inc., Nashua, NH (US)

( * ) Notice: Subject to any disclaimer, the term of this patent is extended or adjusted under 35 U.S.C. 154(b) by 219 days.

(21) Appl. No.: 15/665,656

(22) Filed: Aug. 1, 2017

(65) Prior Publication Data

US 2019/0041178 A1 Feb. 7, 2019

(51) Int. Cl.

| | |
|---|---|
| ***F42B 15/08*** | (2006.01) |
| ***F42B 15/01*** | (2006.01) |
| ***F42B 10/14*** | (2006.01) |
| ***F42B 15/10*** | (2006.01) |
| *F42B 15/00* | (2006.01) |
| *F42B 10/00* | (2006.01) |

(52) U.S. Cl.

CPC ..... *F42B 15/08* (2013.01); *F42B 10/14* (2013.01); *F42B 15/01* (2013.01); *F42B 15/10* (2013.01)

(58) Field of Classification Search

CPC ..... F42B 15/08; F42B 15/01; F42B 10/14; F42B 15/10; F42B 12/365; F42C 13/023; F41G 7/263; F41G 7/224; F41G 7/222; F41G 7/2213; F41G 7/2293; F41G 7/2253

See application file for complete search history.

(56) References Cited

U.S. PATENT DOCUMENTS

| | | | | |
|---|---|---|---|---|
| 3,337,161 A | | 8/1967 | Halton | |
| 3,905,297 A | | 9/1975 | Barr et al. | |
| 4,245,560 A | * | 1/1981 | Rambauske ..... | F42C 13/023 102/213 |

(Continued)

OTHER PUBLICATIONS

International Search Report, PCT/US18/45021, 10 pages, dated Dec. 3, 2018.

*Primary Examiner* — Bernarr E Gregory

(74) *Attorney, Agent, or Firm* — Davis & Bujold, PLLC

(57) ABSTRACT

A mid-body which a cylindrical housing which defines a longitudinal axis and has an interior compartment. A guidance controller is housed within the mid-body for controlling flight. A plurality of wings are connected to the housing and each of the wings is movable into a deployed position to provide guidance during flight. The mid-body has an access window which facilitates communication between the interior compartment of the housing and an external environment. A normally door covers the access window, but when the door is moved, relative to the access window, into an open position, communication between the interior compartment and the external environment is established. An optical sensor is accommodated within the interior compartment and the optical sensor, once the door is moved relative to the access window, can view the external environment and supply data to the guidance controller for controlling operation of the plurality of wings during flight.

13 Claims, 7 Drawing Sheets

(56) References Cited

U.S. PATENT DOCUMENTS 4,409,900 A * 10/1983 Currie ..... F42C 13/023 102/213
4,532,867 A * 8/1985 Mitchell ..... F42C 13/023 102/213
4,638,737 A 1/1987 McIngvale
4,850,275 A * 7/1989 Utreja ..... F41G 7/2293 102/293
4,867,357 A 9/1989 Inglis et al.
4,903,602 A * 2/1990 Skagerlund ..... F42C 13/023 102/213
5,381,139 A * 1/1995 Bensimon ..... F41G 7/222 340/945
5,932,833 A * 8/1999 Hammon ..... F41G 7/2253 102/213
6,851,645 B1 * 2/2005 Williams ..... F41G 7/2293 244/3.15
7,533,849 B2 5/2009 Zemany et al.
8,575,527 B2 * 11/2013 Fry ..... F42B 15/01 244/3.1
9,086,258 B1 * 7/2015 Vasudevan ..... F42B 15/01
2001/0013565 A1 * 8/2001 Davidovitch ..... F41G 7/2213 244/3.16
2002/0109039 A1 * 8/2002 Horwath ..... F41G 7/222 244/3.17
2005/0065668 A1 * 3/2005 Sanghera ..... F41G 7/224 701/3
2008/0196578 A1 * 8/2008 Eden ..... F42B 12/365 89/1.11
2009/0001214 A1 * 1/2009 Williams et al. ..... F42B 15/01 244/3.15
2012/0002049 A1 * 1/2012 Fry ..... F42B 15/08 348/148
2012/0074256 A1 3/2012 Pietrzak et al.
2012/0292432 A1 * 11/2012 Seidensticker ..... F41G 7/263 244/3.16
2012/0312968 A1 12/2012 Eckhardt et al.
2014/0192414 A1 7/2014 Longerich et al.
2015/0247714 A1 3/2015 Teetzel et al.

* cited by examiner

MID BODY SEEKER PAYLOAD

FIELD OF THE INVENTION

The invention relates to an improved mid-body, deployable payload and, more particularly, a mid-body payload comprising a seeker having optics which are accommodated within an internal compartment and can be deployed after launch.

BACKGROUND OF THE INVENTION

A mid-body seeker payload is known in which the seeker optics of the guidance system are retained within the mid-body and designed so as to protect them, as much as possible, from being damaged or obstructed, e.g., dirt, grime, soot, exhaust gases, heat, and flame that typically occur during normal deployment of missiles from a multi projectile magazine, such as those carried under the wings of aircraft or coupled to the exterior of helicopters. Currently, the seeker optics of such guidance systems are located in wings that are deployed after launch and designed to control the flight of the missile (see FIGS. 1 and 2). Each wing has an optical sensor of some type formed within the wing. While the projectile or missile is contained within the magazine, the wings are maintained in their retracted position at least partially accommodated within the mid-body of the missile.

Once the missile is fired or launched from the magazine, the wings are automatically deployed by a guidance controller and pivoted outwardly away from the body to facilitate guiding the missile during flight. Once the wings are deployed, the seeker optics supported thereby are moved in a position so as to provide observation the approaching area, e.g., ground, sky, target, etc. The four seeker optics communicate with a guidance controller and work in concert with one another to detect the location of an intended target to be struck. The guidance controller processes the optical images/signals received from the optics and, in turn, transmits guidance signals to the deployed guidance wings which are suitably controlled so as to guide the missile at the intended target.

Although such wing assemblies protect, to some degree, the optics from becoming damaged or partially or completely obstructed by dirt, grime, soot, exhaust gases, heat, and flame, such systems currently utilize four optical sensors, e.g., one accommodated within each wing and this, in turn, adds to the associated cost for the guidance control system. Moreover, as these optical sensors all continuously transmit data to the guidance control system sometimes it may be somewhat difficult for the guidance control system to determine which of the sensors is seeing what image. For example, which sensor or sensors is/are viewing the ground and/or intended target and which sensor or senses is/are viewing the sky.

Furthermore, the data from the optical sensors is processed under the assumption that the four optical sensors are aligned and constantly maintain this alignment throughout the entire flight of the missile. Misalignment is typically accounted for during a laboratory calibration of the sensors and this tends to introduce error into the reconstruction and degrade system performance. The structure of the wing assemblies is driven by the requirement to effectively become an optical bench operating at supersonic speeds. In addition, the optical sensor that is supported in each of the wings of an airframe, such as a missile, tends to introduce drag due to the additional wing thickness that is typically necessary for accommodating and/or protecting the optical system. The drag caused by the wings also compound the difficulties associated with accurately controlling the flight of the airframe.

SUMMARY OF THE INVENTION

Wherefore, it is an object of the present invention to overcome the above mentioned shortcomings and drawbacks associated with the prior art and provide a missile guidance system which adequately protects the optical sensors, both prior to and during launch of the missile, and also minimizes the amount of optical sensors required for accurate guidance of the airframe as it travels to the intended target. In particular, instead of each wing carrying an optical sensor, the mid-body supports only a single optical sensor which is separate from and installed downstream of the guidance wings. Prior to and during launch, the optical sensor is completely accommodated within an interior compartment of the mid-body and thus sheltered from the dirt, grime, soot, exhaust gases, heat, and flame which typically occur during launch of the airframe. The mid-body is provided with a door panel that slides, pivots or otherwise moves with respect to the mid-body thereby opening an access window through which the optical sensor can thereafter view the external environment and the intended target. The optical sensor is normally located within the interior compartment of the mid-body but may be tilted with respect to the mid-body such that the optical sensor has a forward facing field of view. In this case because the optical sensor is retained within the interior compartment of the mid body, the forward field of view may be somewhat limited. It is preferred that the optical sensor is movable, relative to the access window once, the door panel is deployed, so as to at least partially extend through the access window. Displacement of the optical sensor so as to partially protrude out through the access window of the mid-body provides the optical sensor with an improved forward field of view. If the door is simply slid out of the way along the mid body, the optical sensor can be pivoted or slid so as to project or extend out from the body.

It is also possible for the optical sensor to be secured to the inside surface of the door panel. In this case the door panel will be pivoted with respect to the mid-body so as to extend from the mid-body thereby exposing the optical sensor to the forward field of view. With this design, the door can have a hinge that is arranged parallel to the longitudinal axis such that one lateral side of the door pivots out away from the mid body thereby providing the optical sensor with a forward field of view. It is also possible for the door to have a hinge that is aligned laterally with respect to the longitudinal axis. In this case, the hinge would be located on the trailing end of the door such that the front of the door panel pivots outwardly away from the mid-body thereby exposing the optical sensor to the forward field of view.

With such a system, the door panel can be made inexpensively by simply curving a metal plate so as to have the same or substantially the same radius of curvature as the exterior wall of the mid-body of the missile. The door panel could simply be stamped in an inexpensive manner. In this manner, the door panel forms part of the exterior skin, shell, or casing of the mid-body until the door panel is deployed or opened. Thus the door panel does not take up any interior space of the mid-body. As a result, additional area within the mid-body is thus available for sensor suite/options. Similarly, since only one optical sensor is being used, the need for optical bench wings is eliminated, and with it the overall cost associated with manufacturing wings that accommodate seeker optics. In addition, the overall weight of the optical system is reduced. The savings of interior space and weight can benefit in different configurations of optical sensors.

Since only one optical sensor is used instead of the four optical sensors employed as with prior art systems, the associated costs of the seeker optics is reduced by up to 75%. It should be noted that with one optical sensor, only one quadrant of the forward area is viewable instead of a 360 degree field of view as with the prior art. Since only one sensor is used, it is much easier to determine the upward or downward position of the sensor, i.e., the orientation of the airframe with respect to the ground, horizon or target during flight.

This invention can be used with many different kinds of seeker systems, like a laser seeker, laser guided optics (types of optical and seeker systems). The seeker optics will be protected within the mid-body, meaning the sensitive optical sensors can be temporarily sealed within the mid-body by the panel door and, therefore, will be protected and not be obstructed, damaged or contaminated by debris, exhaust, heat, etc., as one or more neighboring weapons are launched from the launch system. By removing the seeker system from the wings, it becomes possible to simply adapt the seeker and/sensor depending of the needs of the mission. That is to say, the targets and clutter of the target area can define the optimum type of seeker and as the variability of the payload is increased by the reduction of interior space required for the optical bench wings, optimum performance can be achieved by the modular design of the seeker. In this manner, the mid-body can be GPS guided using an imager and a terrestrial mapping/navigation system.

It is an object to arrange a seeker system within the mid-body in such a manner that minimal drag is introduced into the airframe upon deployment of the seeker system.

Another object is to fully enclose the seeker optics within the mid-body of the missile, both during storage and launch, and the seeker optics can be simply deployed during flight without any significant introduction of drag or impairment to the flight characteristics of the airframe.

A further object of the invention is to utilize a movable panel door which can be secured along the mid-body of an airframe during storage and when the airframe is in a launch tube of a launching system. The closed position of the door panel covers and seals the guidance system, including the seeker optics, within an interior compartment of the mid-body of the airframe and thereby protects the seeker optics, including its optical sensors, from being obstructed or damaged by debris, soot, exhaust gases, and heat as one or more neighboring missiles are launched from the launch system. The door panel can be actuated so as to slide, pivot or move with respect to the mid-body of the projectile thereby opening an access window through which seeker optics can thereafter commence observation. The door panel, once moved to its deployed position, is designed to have minimal or negligible affect on the aerodynamic characteristics of the airframe during flight.

Removal of the seeker optics from the guidance wings of the mid-body further simplifies the design and manufacture of the wings as well as reduces the associated costs of the known guidance wings. Since the wings do not comprise, house or support any seeker optics, the wings can be generally easily formed by a conventional stamping process. The wings can be rolled over the body frame, thereby eliminating most of the wing slot seal in the mid-body since they are external to mid-body. Due to this, additional area is available, within the mid-body, to accommodate sensor suite/options thus enabling multiple sensor configurations to be installed as well as long wave and/or short wave infrared imagers.

The present invention also relates to a mid-body for an airframe, both the mid-body and the airframe having a leading end and a trailing end, and the mid-body comprising a cylindrical housing that defines a longitudinal axis and has an interior compartment. A guidance controller is housed within the mid-body for controlling flight of an airframe. A plurality of wings have a first end that is pivotably coupled to the housing adjacent a leading end of each of the plurality of wings. Each of the plurality of wings is movable from a retracted position into a deployed position in which a second end of each of the plurality of wings extends away from the housing to provide guidance during flight. The housing of the mid-body has an access window which facilitates communication between the interior compartment of the housing and an external environment. A door panel having a closed position, in which the door panel covers the access window, and an open position, in which the door panel is moved relative to the access window to facilitate communication between the interior compartment of the housing and the external environment. An optical sensor is accommodated within the interior compartment of the housing and has a forward field of view. The optical sensor, once the door panel is moved into its deployed position, facilitates viewing the external environment and supplying data to the guidance controller for controlling operation of the plurality of wings during flight.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. The invention will now be described, by way of example, with reference to the accompanying drawings in which.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that this disclosure is not limited to the particular embodiments illustrated herein.

DETAILED DESCRIPTION OF THE DRAWINGS

The invention will be understood by reference to the following detailed description, which should be read in conjunction with the appended drawings. It is to be appreciated that the following detailed description of various embodiments is by way of example only and is not meant to limit, in any way, the scope of the present invention.

Figure 1:
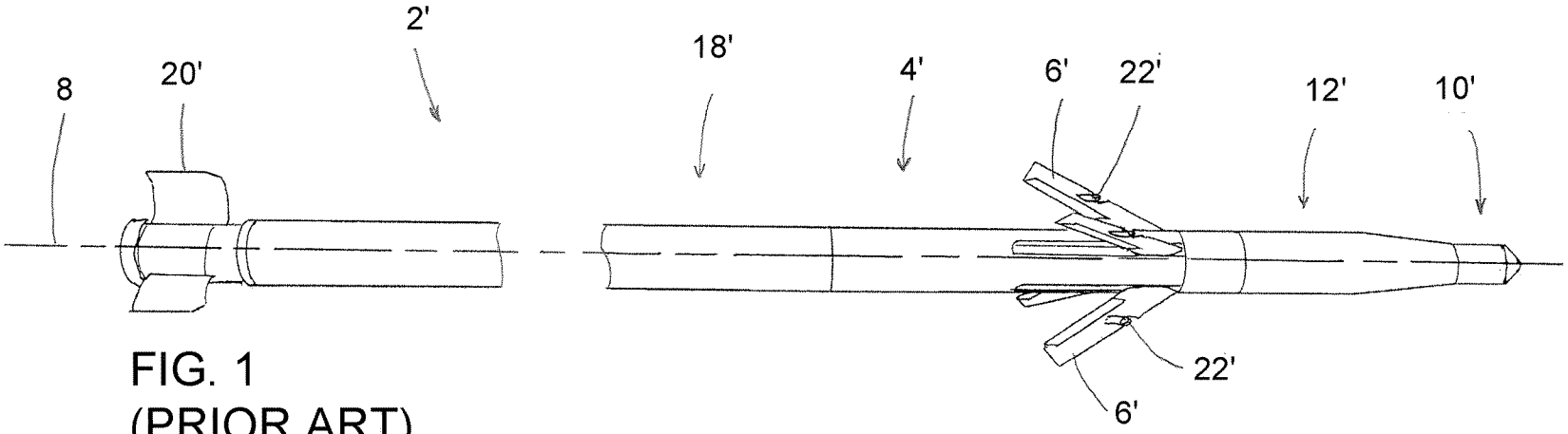
FIG. 1 (PRIOR ART)
FIG. 1 is a pictorial view of prior art airframe having a mid-body including four wing assemblies, each of which is configured with seeker optics.
Figure 2:
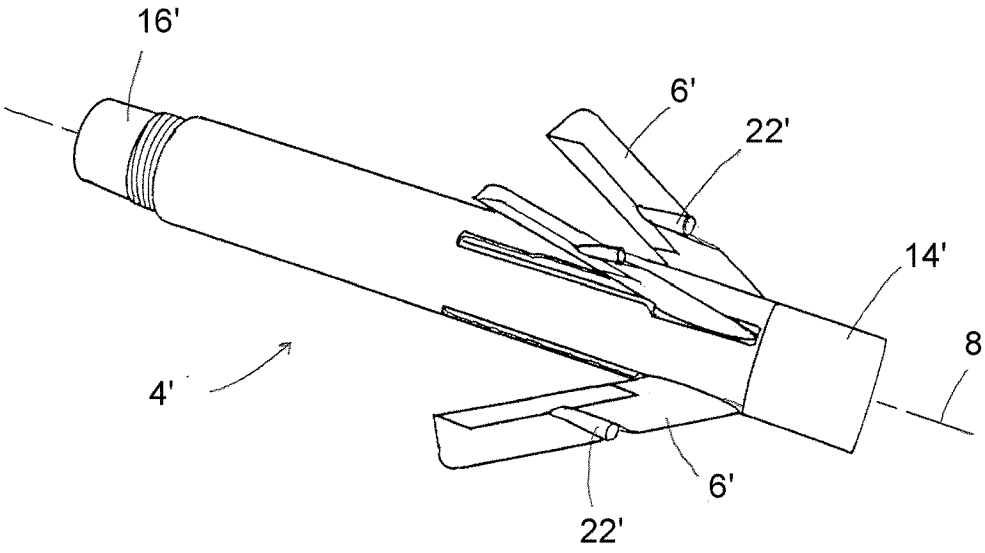
FIG. 2 (PRIOR ART)
FIG. 2 is an enlarged pictorial view of the mid-body of the prior art airframe showing the seeker optics incorporated into the wing assemblies.

FIGS. 1 and 2 diagrammatically illustrate a prior art airframe 2'. A fuse 10'/warhead 12' is supported at or adjacent a leading end of the airframe 2' while a rocket motor 18' is supported at a trailing end thereof. A mid-body 4', which supports four separate wing assemblies 6', is located between the fuse 10'/warhead 12' and the rocket motor 18'. The airframe 2' defines a longitudinal axis or an airframe centerline 8. The fuse 10' functions, in a conventional manner, to detonate the explosive warhead 12', which is located directly behind the fuse 10', upon impact of the airframe 2' with the intended target. The mid-body 4' is located directly behind the warhead 12' and is coupled thereto by a warhead interface 14'. The mid-body 4' also includes the four guidance wings 6' and each one of the four wings 6' supports a separate seeker optical component 22'. A trailing end of the mid-body 4' has a rocket motor interface 16' by which the rocket motor 18' is directly coupled thereto. As is conventional in the art, the rocket motor 18' contains fuel and includes various elements that generally control the firing, combustion or discharge of the fuel from the trailing end and thereby provide launch, propulsion or thrust of the airframe 2' through the air. The trailing end of the airframe 2' includes a plurality of fins 20 which are deployed, after launch, to stabilize and help control the trajectory of the air frame 2'.

Figure 3:
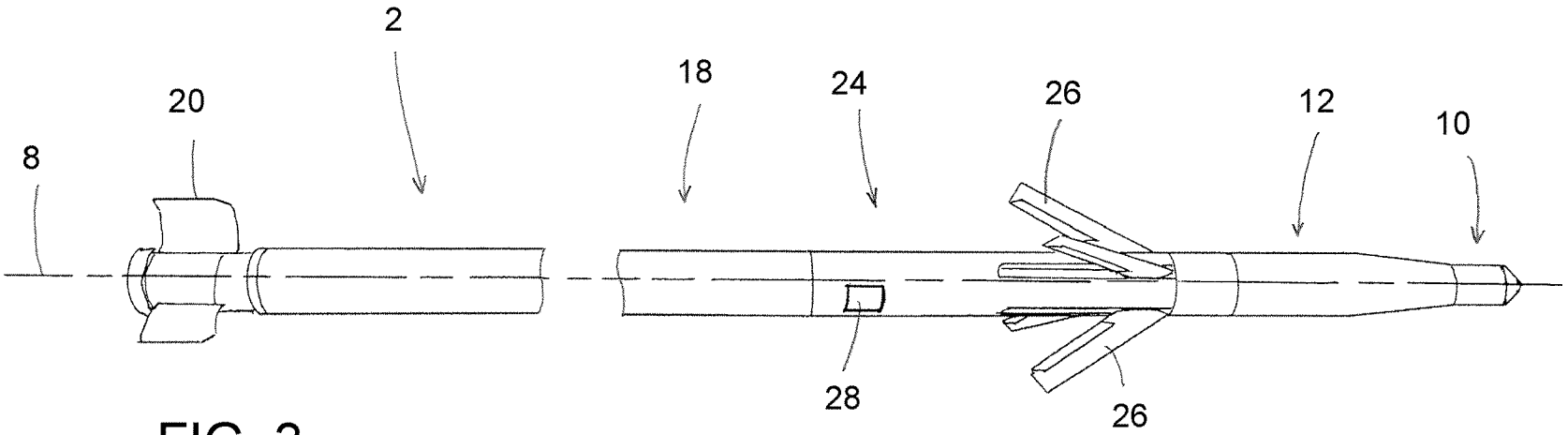
FIG. 3 is a pictorial view of an airframe having a mid-body, according to the invention, including a movable door panel which is located in its normally closed position for sealing and protecting the seeker optics within an interior compartment of the mid-body.
Figure 4:
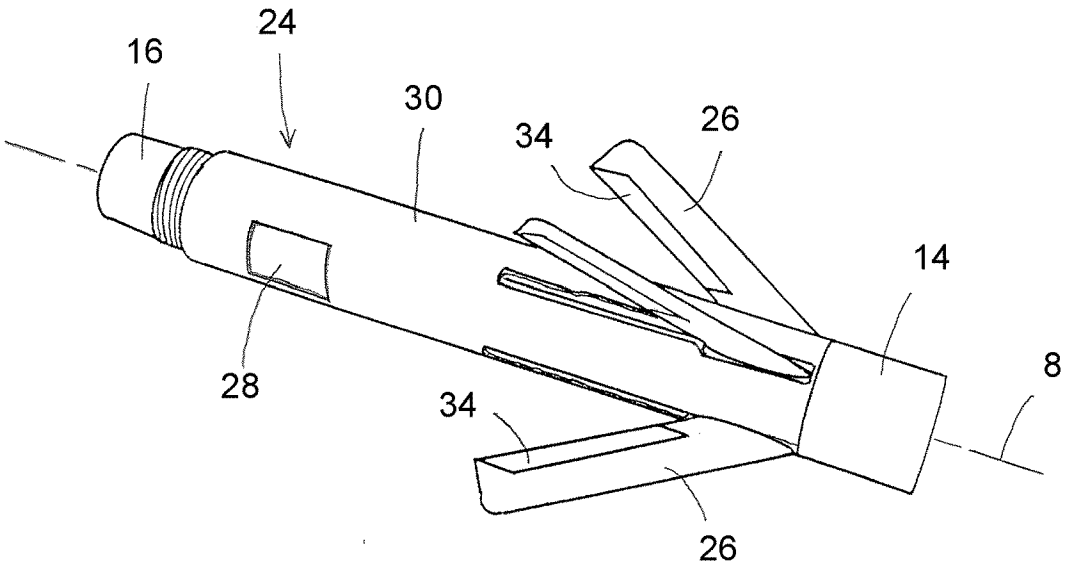
FIG. 4 is an enlarged pictorial view of the mid-body according to the invention showing the movable door panel being located downstream of the wing assemblies.

Turning now to FIGS. 3 and 4, a brief description concerning the various components of a first embodiment of the invention will now be briefly discussed. As can be seen, this embodiment relates to an improved mid-body 24 of an airframe 2, such as a rocket, a missile or a projectile. Similar to the prior art, the airframe 2 defines a longitudinal axis or an airframe centerline 8. A fuse 10/warhead 12 is supported at or adjacent a leading end of the airframe 2 while a rocket motor 18 is supported at a trailing end thereof. A mid-body 4, which supports four separate wing assemblies 26, is located between the fuse 10/warhead 12 and the rocket motor 18. The fuse 10 functions, in a conventional manner, to detonate the explosive warhead 12, which is located directly behind the fuse 10, upon impact of the airframe 2 with the intended target. The mid-body 4 is located directly behind the warhead 12 and is coupled thereto by a warhead interface 14. The mid-body 4 also includes the four guidance wings 26. A trailing end of the mid-body 4 has a rocket motor interface 16 by which the rocket motor 18 is directly coupled to the mid-body 4. As is conventional in the art, the rocket motor 18 contains fuel and includes various elements that generally control the firing, combustion or discharge of the fuel from the trailing end of the airframe 2 and thereby provides launch, propulsion or thrust of the airframe 2 through the air. The trailing end of the rocket includes a plurality of fins 20 which are normally deployed, after launch of the airframe 2, to stabilize and help control the trajectory thereof.

As shown in FIGS. 3 and 4, the mid-body 24 includes a plurality of guidance wings 26 that are generally evenly spaced about the circumference of the mid-body just behind the warhead interface 14. A leading end of each of the wings 26 is pivotally connected to the mid-body 24 such that a first end of the wings 26 is pivotably secured to the housing while the opposite second end of the wings 26 can be pivoted away from their normally retracted position, in which each of the wings 26 extends parallel to the housing (not shown) during storage and launch of the airframe 2, to a deployed position (see FIGS. 3 and 4) following launch. In the retracted position, the wings 26 are at least partially contained or accommodated within a wing recess formed in the exterior surface of the mid-body housing 30 and this stowed arrangement of the wings 26 facilitates storage and loading of the airframe 2 into a launch magazine. Following launch of the airframe 2 from the launch magazine, the wings 26 are automatically deployed and moved, in a conventional manner by the guidance controller 64, into their deployed position (see FIGS. 3 and 4), that is to say the second ends of the wings 26 are pivoted outwardly away from the mid-body housing 30.

According to the invention, the guidance wings 26 do not include, support, or house any seeker optics. As a result of this, the wings 26 can be formed simply and oriented closely adjacent to exterior surface 42 of the mid-body housing 30 of the airframe 2. Accordingly, much of the wing slot seal and the interior compartment 32, previously required within the mid-body 24 for retraction of the wings 26, can be eliminated.

Each of the wings 26 have one or more movable/pivotable flaps 34 that are controlled by the guidance controller 64, based on signals received by the optical system (see FIG. 9), so as to adjust the yaw and the pitch, and thus the trajectory of the airframe 2. The guidance wings 26 of the mid-body 24, in contrast to the wings 6' according to prior art, are not specially designed or manufactured to carry or include any seeker optics or optical sensors 22', but instead are generally substantially planar and have continuous, uninterrupted, smooth leading edge 36 as well as aerodynamically streamlined side surfaces 38. The wings 26 and the flaps 34 are designed and shaped so as to cause minimal drag and facilitate improved control of the trajectory of the airframe 2 during flight. As the design, construction and form of such wings 26 and the control thereof are generally well known in the art, a further description concerning the same is not believed to be necessary. Due to the above simplified design, the wings 26 of the mid-body 24 can be manufactured and installed relatively inexpensively and simply in comparison to the prior art wings.

A door panel 28 is supported by the mid-body 24 of the airframe 2, between the wings 26 and the rocket motor interface 16. In FIGS. 3 and 4, the door panel 28 is shown in its normally sealed and closed position. In this position, the door panel 28 forms a portion of the exterior housing 30 of the mid-body 24. The guidance controller 64 controls actuation and movement of the door panel 28 into a deployed position, and a further discussion concerning the same will be provided below. The door panel 28, when in its normally closed position, seals and covers an access window 54 which communicates with an internal compartment 32 contained within the mid-body 24. An optical sensor 56 is accommodated within the interior compartment 32 and further discussion concerning the function and purpose of the optical sensor 56 will be provided below.

The mid-body 24, as shown in FIGS. 5A-8C, comprises the access window 54 and the door panel 28 that are both located downstream of the guidance wings 26. The door panel 28 can be formed as a generally rectangular plate which has a length from a leading edge 46 to a trailing edge 48 and a width from a first side edge 50 to an opposite second side edge 52 so as to completely cover the access window 54. The door panel 28 is generally arranged such that the length of the panel is at least substantially parallel to the longitudinal axis 8 of the airframe 2. The length of the door panel 28 is typically generally greater than the width of the door panel 28, although this is not an absolute requirement. The door panel 28 can be made from a metal plate that is rolled into a curved configuration or simply stamped in an inexpensive manner. The door panel 28 has a wall thickness that is either substantially the same or somewhat thinner than the wall thickness of the housing 30 of the mid-body 24. The door panel 28 is such that an outer surface 40 thereof, in the closed position of the door panel 28, is substantially flush with the exterior surface 42 of the mid-body housing 30. In other words, the curved metal plate has the same outer radius of curvature or diameter as the cylindrical housing 30 of the mid-body 24 when the door panel 28 is in its closed position. As a result, the door panel 28 does not take up any appreciable space of the interior compartment 32 of the mid-body 24. Accordingly, additional space within the mid-body 24 is then available for accommodating other components such as sensor/options, etc.

When the door panel 28 is in its closed position, the door panel 28 closes the access opening or window 54 formed in the mid-body 24 which provides access to the interior compartment 32. The outer edges 46, 48, 50, 52 of the door panel 28 and inner edges of the access window 54 can be chamfered or have shoulders that mate with each other to help support and permit relative movement of the door panel 28 with respect to the mid-body 24. It is possible that the outer edges 46, 48, 50, 52 of the door panel 28 and/or the inner edges of the window 54 may be provided with a sealing gasket or some other conventional seal such that when the door panel 28 is in its closed position, the interior compartment 32 of the mid-body 24 is completely sealed with respect to the external environment. Such seal helps prevent any soot, dirt, debris, exhaust particles, heat, etc., from entering into the interior compartment 32 of the mid-body 24 via the access window 54 and possibly damaging an optical sensor 56. The door panel 28 is connect to the housing 30 of the mid-body 24 in such a manner that the guidance controller 64 actuates a door panel actuator 65 which moves, pivots or slides the door panel 28 with respect to the mid-body 24 and thereby opens the access window 54 so that the optical sensor 56, accommodated within the interior compartment 32, can view the external environment.

Figure 5A:
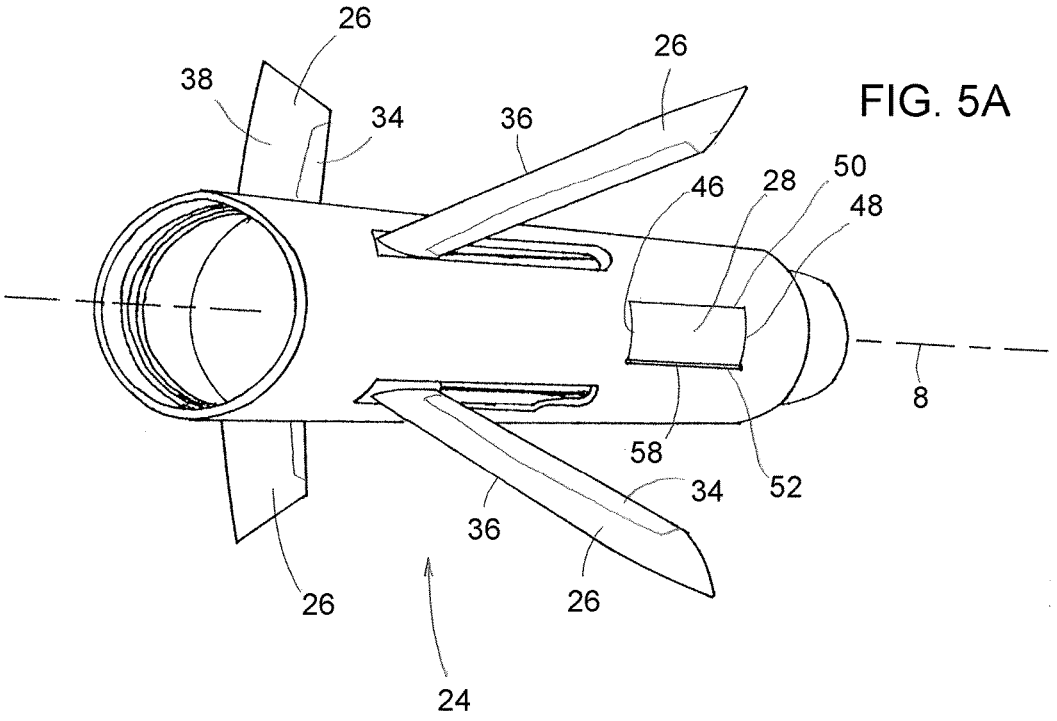
FIG. 5A is a view of a mid-body according to the invention having a door that is connected thereto by a longitudinally extending hinge.
Figure 5B:
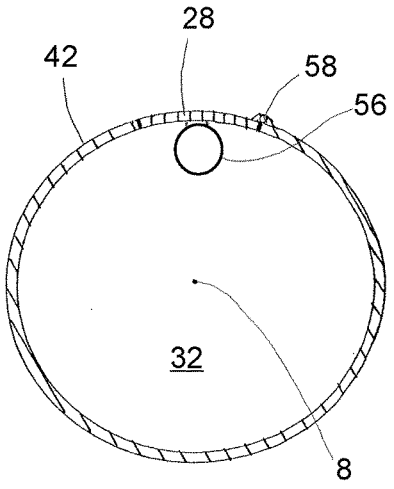
FIG. 5B is a sectional view of the mid-body of FIG. 5A with the door in its normally closed position.
Figure 5C:
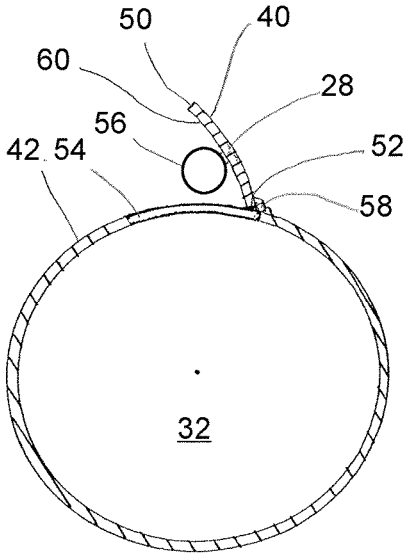
FIG. 5C is a sectional view of the mid-body of FIG. 5A with the door shown in its open position.
Figure 6A:
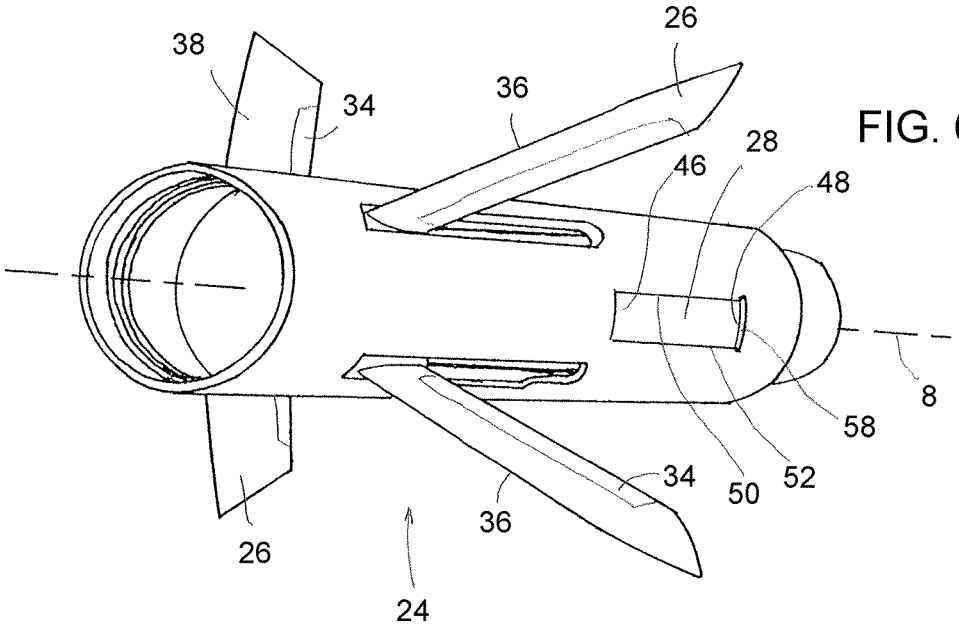
FIG. 6A is a view of a mid-body according to the invention having a door that is connected thereto by a laterally extending hinge.
Figure 6B:
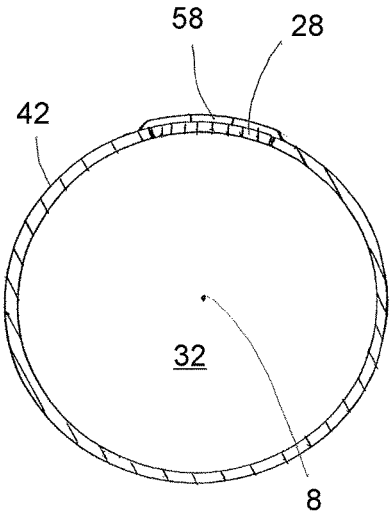
FIG. 6B is a sectional view of the mid-body of FIG. 6A with the door in its normally closed position.
Figure 6C:
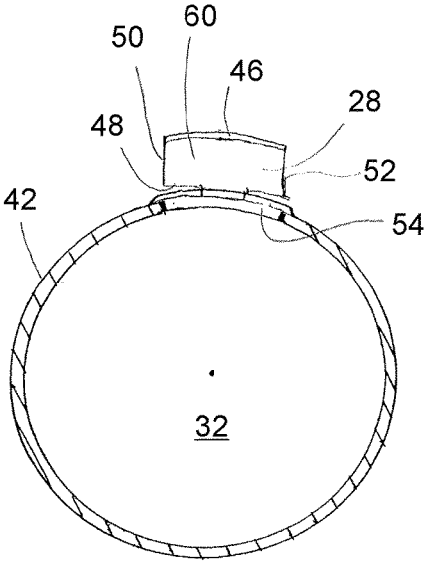
FIG. 6C is a sectional view of the mid-body of FIG. 6A with the door in its open position.
Figure 7A:
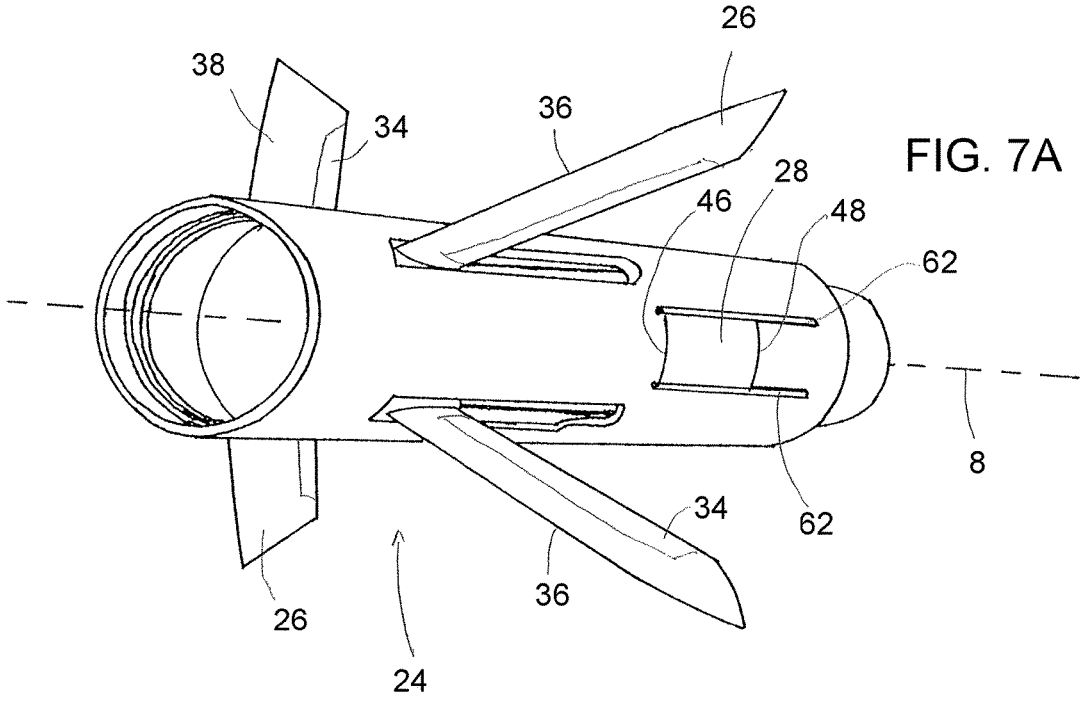
FIG. 7A is a view of a mid-body according to the invention having a door that is connected to the housing via a pair of opposed longitudinal tracks.
Figure 7B:
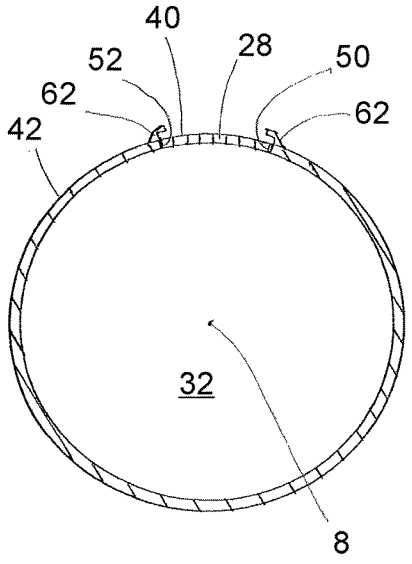
FIG. 7B is a sectional view of the mid-body of FIG. 7A with the door in its closed position.
Figure 7C:
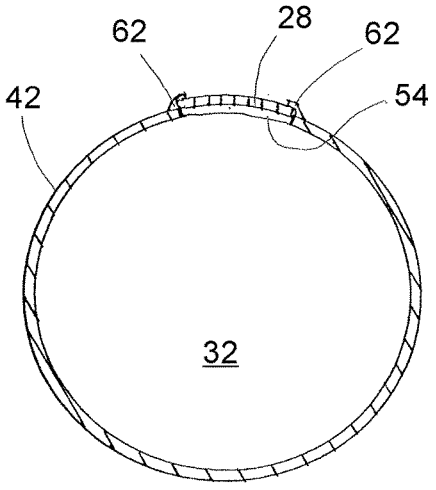
FIG. 7C is a sectional view of the mid-body of FIG. 7A with the door in its open position.

A longitudinal edge of the door panel 28 can be secured to the housing via a hinge 58 which enables the door to pivot outwardly away from the mid-body 24. The hinge 58 can be located, for example, along either one of the longitudinal side edges of the door panel 28, as shown in FIGS. 5A, 5B and 5C, or along the trailing edge of the door panel 28, as shown in FIGS. 6A, 6B and 6C. If the hinge 58 is located along one of the longitudinal side edges 50, 52 of the door panel 28, when the door panel 28 is actuated by the door panel actuator 65, that is controlled by the guidance controller 64, and pivoted into the deployed position, thereafter, the access window 54 is opened. However, leading edge 46 of the door panel 28 becomes fully exposed to the air flowing around the airframe 2 during flight and the hinge 56 is a one way hinge which prevents the door panel 28 from moving back to is closed position.

Similarly, if the hinge 58 located along the trailing edge 48 of the door panel 28, when the door panel 28 is pivoted to its opened and deployed position via the door panel actuator, controlled by the guidance controller, the access window 54 is opened, however, the interior surface 60 of the door becomes directly exposed to the air flowing around the airframe 2 during flight. It is to be appreciated that hinges 58 can be secured to the exterior surfaces of the door panel 28 and mid-body 24 in a conventional manner, such as by screws, rivots or welds such that when deployed the door panel 28 remains fixed to the housing 30 of the mid-body 24. Likewise, hinges (not shown) can be connected to the interior surfaces of the of the door panel 28 and mid-body 24. Although hinges 58 can have a low profile and facilitate pivoting of the door panel 28 into the opened and deployed positions, when supported by a hinge 58 and deployed, the door panel 28 projects from the housing 30 of the mid-body 24 and may introduce a small amount of drag on the airframe 2 during flight.

Figure 8A:
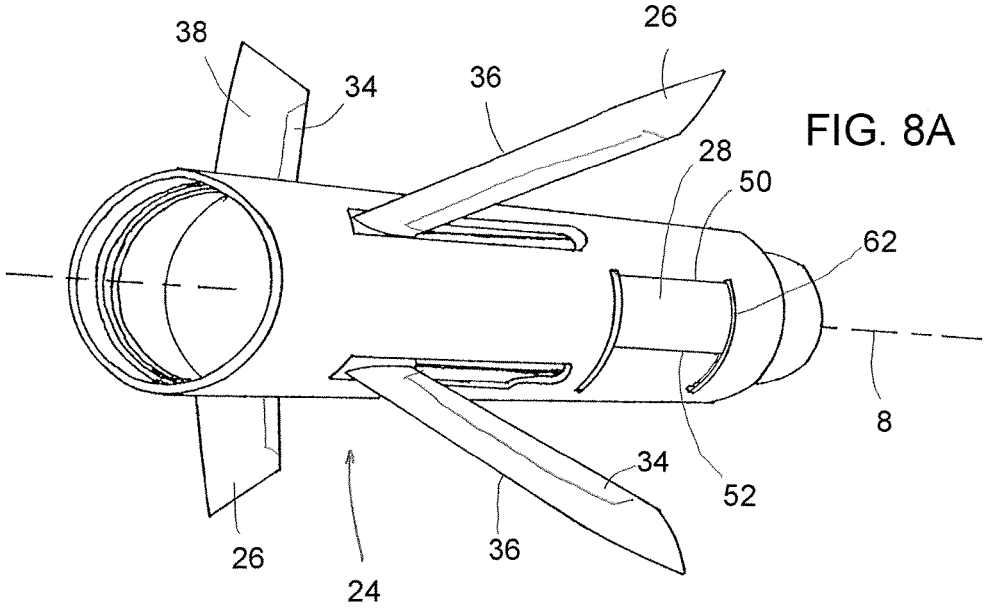
FIG. 8A is a view of a mid-body according to the invention having a door that is connected to the housing via a pair of lateral tracks.
Figure 8B:
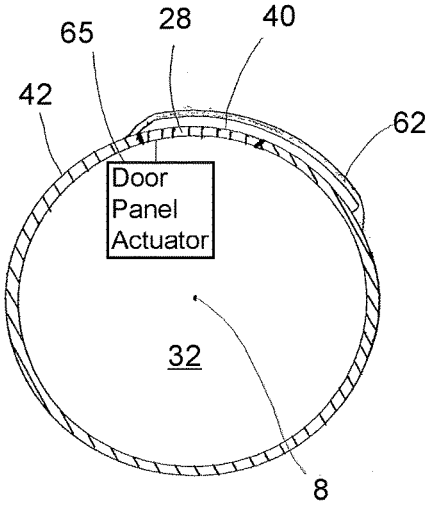
FIG. 8B is a sectional view of the mid-body of FIG. 8A with the door in its closed position.
Figure 8C:
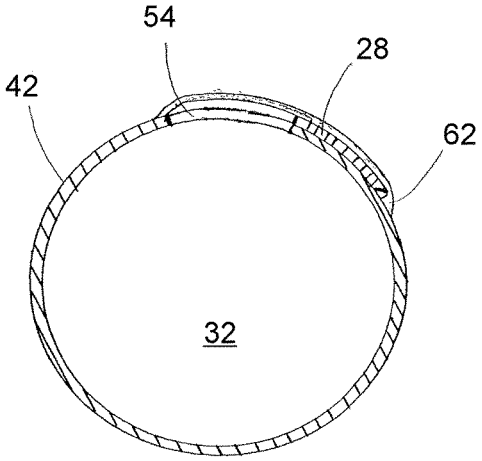
FIG. 8C is a sectional view of the mid-body of FIG. 8A with the door in its open position.

According to another embodiment, the exterior surface 42 of the mid-body 24 has a pair of guide tracks 62 that extend along the opposite side edges of the access window 54 (see FIGS. 7A-7C) or along the leading and trailing edges of the access window 54 (see FIGS. 8A-8C). That is to say, the tracks 62 can be arranged either parallel (see FIGS. 7A-7C) or perpendicular to the longitudinal axis 8 of the airframe 2 (see FIGS. 8A-8C). The tracks 62 are formed to generally be adjacent or overhang the edges of the access window 54 and receive a mating side or end edges 46, 48, 50, 52 of the door panel 28 as the door panel 28 is moved or slid from its closed position into its deployed position by means of the door panel actuator 65. In this manner, the door panel 28 can slide sideways, either laterally about the circumference of the mid-body housing 30 or either forward or rearward, parallel to the longitudinal axis 8, along the exterior surface 42 of the mid-body-housing 30. The tracks 62 captively assist with retaining the door panel 28 in at least the deployed position relatively close to the housing 30 so that the door panel 28 has a low profile and minimizes the amount of drag introduced to the airframe 2 during flight.

Figure 9:
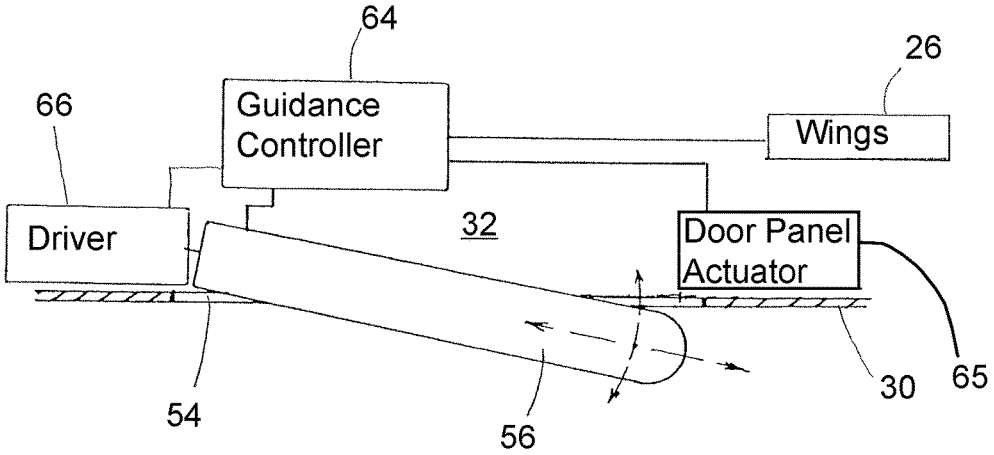
FIG. 9 is a diagrammatic cross section of a portion of the mid-body according to the invention including the seeker optics and guidance system.

It is to be appreciated that instead of the door panel 28 being movably coupled to the mid-body 24 by a hinge 52, a pair of tracks 62, or some other slidable attachment mechanism, the door panel 28, once deployed, may become completely dislodged and separated from the mid-body 24, as generally shown in the embodiment of FIG. 9, and eventually be permitted to fall to the ground due to gravity. In this case, the door panel 28 can be releasably connected to the mid-body housing 30 such that when the airframe 2 is contained within a launch magazine, the access window 54 is covered and closed by the door panel 28. Following launch of the airframe 2 from the launch magazine, the door panel actuator 65, controlled by the guidance controller 64, is actuated to force the door panel 28 away from the access window 54 and the housing 30 and, thereafter, be permitted to fall away from the mid-body 24 as the airframe 2 travels toward the intended target.

Instead of a mid body with four optical sensors, one on each wing, the inventive mid-body 24 only comprises a single optical sensor 56 that is placed downstream of the guidance wings 26. As diagrammatically shown in FIG. 9, the optical sensor 56 is normally retained within the internal compartment of the housing 30 of the mid-body 24 and normally protected therein by the door panel 28. As soon as the guidance controller 64 activates the door panel actuator 65 to move the door panel 28 into its deployed position, a conventional driver 66 slides, pivots, displaces or otherwise deploys the optical sensor 56 so that the leading optical end thereof at least partially projects or extends out through the access window 54 of the mid-body 24 to achieve a desired forward field of view for the optical sensor 56. Alternatively, instead of employing the conventional driver 66, it is to be appreciated that the optical sensor 56 can be fixedly positioned within the internal compartment 32 in an inclined orientation so that, as soon as the door panel 28 is moved into its deployed position, the optical sensor 56 is arranged to have a sufficient forward field of view.

Alternatively, it is also possible for the optical sensor 56 to be secured to the inside of the door panel 28, such as shown in FIG. 5A, 5B and 5C or possibly in FIGS. 6A, 6B and 6C. According to FIGS. 5A, 5B and 5C, as the door panel 28 pivots about the hinge 58 with respect to the mid-body housing 30 away from the interior compartment 32, the optical sensor 56 is automatically arranged to have a sufficient forward field of view. The same would occur with respect to in FIGS. 6A, 6B and 6C. For all application, the optical sensor 56 is coupled to the guidance controller 64 by an electrical cable to facilitate sending signals/data thereto.

The forward field of view of the optical sensor 56 will now be described with reference to FIGS. 10 and 11, which diagrammatically illustrate a leading portion of the airframe 2 traveling in a forward direction, as indicated by arrow F. The wings 26 of the mid-body 24 are not illustrated in FIGS. 10 and 11 so as to clarify the description concerning the forward field of view of the optical sensor 56.

Figure 10:
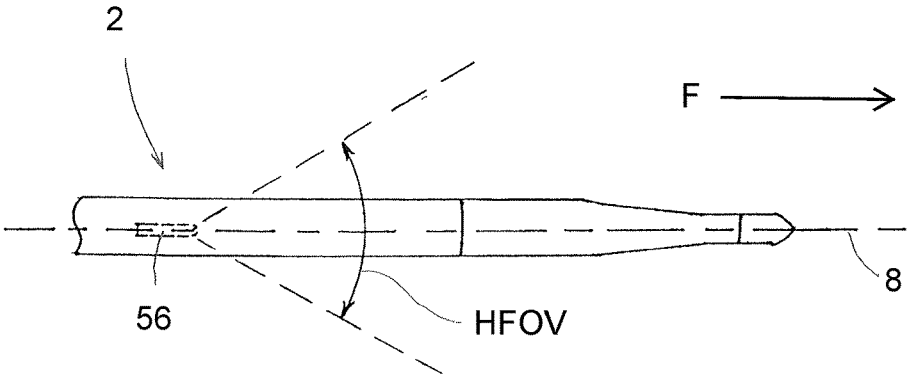
FIG. 10 is a diagrammatic top plan view of the airframe having a mid-body according to the invention showing a horizontal field of view of the seeker optics.
Figure 11:
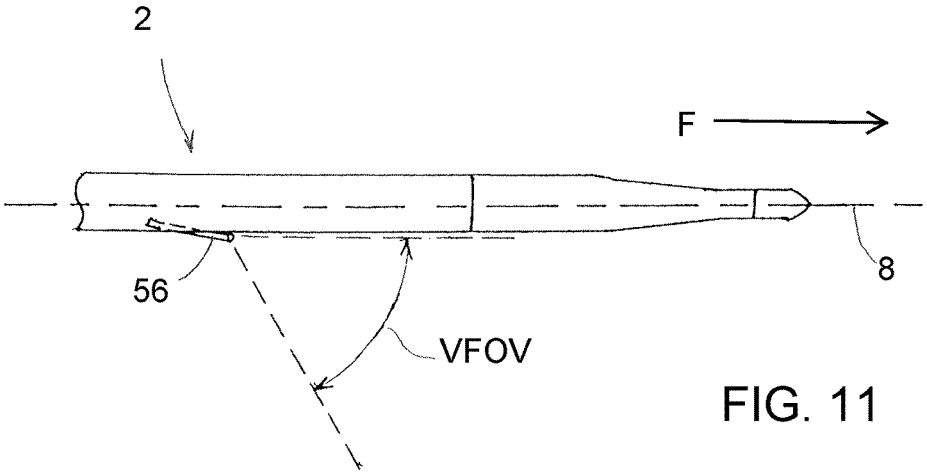
FIG. 11 is a diagrammatic side elevational view of the airframe having a mid-body according to the invention showing a vertical field of view of the seeker optics.

The forward field of view of the optical sensor 56 is understood to comprise a combination of both (1) a horizontal field of view HFOV, as shown in FIG. 10, and (2) a vertical field of view VFOV, as shown in FIG. 11. The horizontal field of view HFOV generally comprises a horizontal viewing area in front of and to the left and the right of the airframe 2 that can be viewed or observed by the optical sensor 56, as the airframe 2 travels during flight. The vertical field of view VFOV generally comprises a vertical viewing area in front of and vertically below the airframe 2 that can be viewed or observed by the optical sensor 56, as the airframe 2 travels during flight. Stated in another way, the horizontal field of view HFOV of the optical sensor 56 is the viewing area extending from a left side to a right side of the longitudinal axis 8 of the airframe 2, while the vertical field of view VFOV of the optical sensor 56 is the viewing area extending generally from vertically below the optical sensor 56 to an area adjacent the leading end of the airframe 2. The optical sensor 56 typically has a horizontal and a vertical field of view HFOV, VFOV that ranges between 30 degrees to 60 degrees. More preferably, the horizontal field of view HFOV of the optical sensor 56 preferably ranges between 40 degrees to 50 degrees while the vertical field of view VFOV of the optical sensor 56 also preferably ranges between 40 degrees to 50 degrees.

Since only one optical sensor 56 is utilized by the guidance controller 64, the associated cost of the optical system is greatly reduced, e.g., by up to 75% in comparison to currently known optical systems. It should be noted that with one optical sensor 56, only one quadrant of the forward field of view, e.g., 90 degrees or less, will be viewed instead of a 360 degree field of view as with the prior art systems. Since only one optical sensor 56 is utilized, it is generally much easier for the guidance controller 64 to determine an upward or a downward facing orientation of the optical sensor 56, i.e., the orientation of the airframe 2 with respect to the ground. Furthermore, processing of the signals received by the guidance controller 64 from the single optical sensor 56 is greatly simplified in comparison to processing of signals being received from four optical sensors. This results in control signals being transmitted by the guidance controller 64 to the wings 26 at an improved rate, thereby enhancing control of the wings 26 and the flaps 34 as well as improving the overall flight characteristics of the airframe 2 during flight.

While various embodiments of the present invention have been described in detail, it is apparent that various modifications and alterations of those embodiments will occur and be readily apparent to those skilled in the art. However, it is to be expressly understood that such modifications and alterations are within the scope and spirit of the present invention, as set forth in the appended claims. Further, the invention described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. A mid-body for an airframe, both the mid-body and the airframe having a leading end and a trailing end, and the mid-body comprising:

a cylindrical housing defining a longitudinal axis and having an interior compartment;

a guidance controller being housed within the mid-body for controlling flight of an airframe;

a plurality of wings having a first end pivotably coupled to the housing adjacent a leading end of each of the plurality of wings, and each of the plurality of wings being movable from a retracted position into a deployed position in which a second end of each of the plurality of wings extends away the housing to provide guidance during flight;

the housing of the mid-body having an access window which facilitates communication between the interior compartment of the housing and an external environment;

a door panel having a closed position, in which the door panel covers the access window, and an open position, in which the door panel is moved relative to the access window to facilitate communication between the interior compartment of the housing and the external environment, wherein both the access window and the door panel are located between the plurality of wings and a rocket motor interface which facilitates connection of the mid-body to a rocket motor; and an optical sensor being accommodated within the interior compartment of the housing and having a forward field of view, and the optical sensor, once the door panel is moved into its deployed position, facilitates viewing the external environment and supplying data to the guidance controller for controlling operation of the plurality of wings during flight.

2. The mid-body of the airframe according to claim 1, wherein the door panel, when in its normally closed position, seals and covers the access window and protects the optical sensor accommodated within the internal compartment.

3. The mid-body of the airframe according to claim 2, wherein the optical sensor is connected to a driver and the guidance controller, the driver moves the optical sensor relative to the access window such that the optical sensor partially extends through the access window.

4. The mid-body of the airframe according to claim 1, wherein the leading end of the mid-body has a warhead interface which facilitates connection of the mid-body to a warhead, and the trailing end of the mid-body has the rocket motor interface which facilitates connection of the mid-body to the rocket motor.

5. The mid-body of the airframe according to claim 4, wherein the plurality of wings comprise four guidance wings, wherein each wing has a first end which is pivotably secured to the housing, while an opposite second end of each wing is pivotable into a deployed position following launch.

6. The mid-body of the airframe according to claim 1, wherein the plurality of wings, when in a stored position, are at least partially accommodated within a wing recess, formed in an exterior surface of the mid-body, to facilitate storage and loading of the airframe into a launch magazine.

7. The mid-body of the airframe according to claim 1, wherein each of the plurality of wings have at least one movable/pivotable flap that is controlled by the guidance controller for adjusting a yaw and pitch, and thus a trajectory of the airframe during flight.

8. The mid-body of the airframe according to claim 1, wherein the mid-body comprises only a single optical sensor which has a horizontally forward field of view ranging between 30 and 60 degrees and a vertical forward field of view ranging between 30 and 60 degrees.

9. The mid-body of the airframe according to claim 1, wherein a fuse and a warhead are connected to the leading end of the mid-body while a rocket motor is connected to the trailing end of the mid-body.

10. The mid-body of the airframe according to claim 1, wherein the door panel is coupled to the housing by a hinge, the hinge is fixedly attached along a longitudinal edge of the door panel and the access window to facilitating pivoting of the door panel from its closed to its deployed position.

11. The mid-body of the airframe according to claim 1, wherein the door panel is coupled to the housing by a hinge, and the hinge is fixed attached along a trailing edge of the door panel and the access window to facilitating pivoting of the door panel from its closed to its deployed position.

12. The mid-body of the airframe according to claim 1, wherein the door panel is detachably coupled to the access window such that the door panel, when deployed by the door panel actuator, becomes completely separated from the mid-body.

13. The mid-body of the airframe according to claim 1, wherein the mid-body has a pair of opposed tracks which mate with opposed edges of the door panel to facilitate sliding movement of the door panel, relative to the access window, and movement of the door panel from its closed to its deployed position.

* * * * *